US009932700B2

(12) United States Patent
Wells et al.

(10) Patent No.: US 9,932,700 B2
(45) Date of Patent: Apr. 3, 2018

(54) CLEANING APPARATUS AND METHOD

(71) Applicant: Xeros Limited, Rotherham (GB)

(72) Inventors: Simon Paul Wells, Rotherham (GB); Michael David Sawford, Rotherham (GB); Gareth Evan Lyn Jones, Bath (GB)

(73) Assignee: Xeros Limited, Rotherham (GB)

( * ) Notice: Subject to any disclaimer, the term of this patent is extended or adjusted under 35 U.S.C. 154(b) by 146 days.

(21) Appl. No.: 14/777,559

(22) PCT Filed: Mar. 18, 2014

(86) PCT No.: PCT/GB2014/050854

§ 371 (c)(1),
(2) Date: Sep. 16, 2015

(87) PCT Pub. No.: WO2014/147389

PCT Pub. Date: Sep. 25, 2014

(65) Prior Publication Data

US 2016/0122932 A1 May 5, 2016

(30) Foreign Application Priority Data

Mar. 20, 2013 (GB) ..... 1305120.6

(51) Int. Cl.

| | |
|---|---|
| ***B08B 3/04*** | (2006.01) |
| ***D06F 37/04*** | (2006.01) |
| ***D06F 58/02*** | (2006.01) |
| ***D06F 35/00*** | (2006.01) |
| *D06F 37/06* | (2006.01) |

(52) U.S. Cl.

CPC ..... *D06F 37/04* (2013.01); *D06F 35/00* (2013.01); *D06F 58/02* (2013.01); *D06F 37/06* (2013.01)

(58) Field of Classification Search

None

See application file for complete search history.

(56) References Cited

U.S. PATENT DOCUMENTS

| | | | |
|---|---|---|---|
| 5,498,115 | A | 3/1996 | Perneborn |
| 8,959,961 | B2 | 2/2015 | Jenkins et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |

(Continued)

FOREIGN PATENT DOCUMENTS

| | | | |
|---|---|---|---|
| CN | 102061588 | A | 5/2011 |
| CN | 102061589 | A | 5/2011 |

(Continued)

OTHER PUBLICATIONS

U.S. Appl. No. 14/588,500, Xeros Ltd.

(Continued)

*Primary Examiner* — Eric W Golightly
(74) *Attorney, Agent, or Firm* — Clark & Elbing LLP

(57) ABSTRACT

The invention provides an apparatus and method for use in the treatment of substrates, the apparatus comprising housing means (1) having a first upper chamber having mounted therein a rotatably mounted cylindrical cage (2), a second lower chamber located beneath said cylindrical cage (2), at least one recirculation means, access means, pumping means, and a multiplicity of delivery means, whereby both the apparatus and the method find particular application in the cleaning of soiled textile fabrics.

19 Claims, 2 Drawing Sheets

(56) References Cited

U.S. PATENT DOCUMENTS

| | | | |
|---|---|---|---|
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,619 | B2 | 12/2017 | Wells et al. |
| 2008/0202435 | A1 | 8/2008 | Nowacek |
| 2009/0276966 | A1 | 11/2009 | Mette et al. |
| 2011/0296628 | A1 | 12/2011 | Jenkins et al. |
| 2012/0048299 | A1 | 3/2012 | Jenkins et al. |
| 2012/0284931 | A1 | 11/2012 | Jenkins et al. |
| 2012/0304400 | A1 | 12/2012 | Jenkins et al. |
| 2013/0061404 | A1 | 3/2013 | Jenkins |
| 2013/0167882 | A1 | 7/2013 | Burkinshaw et al. |
| 2013/0276242 | A1 | 10/2013 | Jenkins et al. |
| 2013/0283542 | A1 | 10/2013 | Jenkins et al. |
| 2013/0340487 | A1 | 12/2013 | Yin et al. |
| 2014/0123402 | A1 | 5/2014 | He et al. |
| 2014/0201929 | A1 | 7/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0152585 | A1 | 6/2015 | Sawford et al. |
| 2015/0175945 | A1 | 6/2015 | Waddon et al. |
| 2015/0252511 | A1 | 9/2015 | Roberts et al. |
| 2015/0344824 | A1 | 12/2015 | Burkinshaw et al. |
| 2016/0032522 | A1 | 2/2016 | Steele |
| 2016/0040260 | A1 | 2/2016 | Steele |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |
| 2017/0051447 | A1 | 2/2017 | He et al. |
| 2017/0137983 | A1 | 5/2017 | He et al. |
| 2017/0159222 | A1 | 6/2017 | Jenkins et al. |
| 2017/0240980 | A1 | 8/2017 | Feyisa et al. |
| 2017/0240981 | A1 | 8/2017 | Scott |
| 2017/0240982 | A1 | 8/2017 | Sadeghi |
| 2017/0241061 | A1 | 8/2017 | Wells et al. |
| 2017/0247771 | A1 | 8/2017 | Scott |
| 2017/0267949 | A1 | 9/2017 | Bird et al. |

FOREIGN PATENT DOCUMENTS

| | | | |
|---|---|---|---|
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202401272 | U | 8/2012 |
| CN | 202492706 | U | 10/2012 |
| CN | 202543632 | U | 11/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |
| CN | 205329374 | U | 6/2016 |
| CN | 205329380 | U | 6/2016 |
| CN | 205329384 | U | 6/2016 |
| DE | 3527724 | A1 | 2/1987 |
| DE | 3803195 | A1 | 8/1989 |
| EP | 0635595 | A1 | 1/1995 |
| EP | 2749685 | A1 | 7/2014 |
| GB | 2473224 | A | 3/2011 |
| WO | WO-2010/094959 | A1 | 8/2010 |
| WO | WO-2011/064581 | A1 | 6/2011 |
| WO | WO-2011/098815 | A1 | 8/2011 |
| WO | WO-2012/098408 | A2 | 7/2012 |
| WO | WO-2013/016902 | A1 | 2/2013 |

OTHER PUBLICATIONS

U.S. Appl. No. 14/588,510, Xeros Ltd.
U.S. Appl. No. 14/777,568, Xeros Ltd.
U.S. Appl. No. 14/777,573, Xeros Ltd.
U.S. Appl. No. 14/782,719, Xeros Ltd.
U.S. Appl. No. 14/782,729, Xeros Ltd.
U.S. Appl. No. 14/902,498, Xeros Ltd.
U.S. Appl. No. 14/902,506, Xeros Ltd.
International Search Report and Written Opinion for International Application No. PCT/GB2014/050854, dated Aug. 5, 2014 (12 pages).
Search Report for United Kingdom Application No. GB1305120.6, dated Jul. 18, 2013 (3 pages).

PRIOR ART

CLEANING APPARATUS AND METHOD

FIELD OF THE INVENTION

The present invention relates to an apparatus for the treatment of substrates, specifically textile fibres and fabrics, using solid particulate material. More specifically, the invention is concerned with an apparatus which provides for the use of such solid particulate material in a system adapted to optimise mechanical interaction between said particulate material and substrates, and which facilitates the recirculation of said particulate material during treatments and their easy removal from said substrates after completion of the treatments which facilitates their re-use for subsequent operations. The invention also relates to a method for using said apparatus for treating a substrate.

BACKGROUND TO THE INVENTION

Aqueous cleaning processes are a mainstay of both domestic and industrial textile fabric washing. On the assumption that the desired level of cleaning is achieved, the efficacy of such processes is usually characterised by their levels of consumption of energy, water and detergent. In general, the lower the requirements with regard to these three components, the more efficient the washing process is deemed. The downstream effect of reduced water and detergent consumption is also significant, as this minimises the need for disposal of aqueous effluent, which is both extremely costly and detrimental to the environment.

Such washing processes, whether involving domestic washing machines or their industrial equivalents (usually referred to as washer extractors) involve aqueous submersion of fabrics followed by soil suspension, aqueous soil removal, and water rinsing. In general, the higher the level of energy (or temperature), water and detergent which is used, the better the cleaning. One significant issue, however, concerns water consumption, as this sets the energy requirements (in order to heat the wash water), and the detergent dosage (to achieve the desired detergent concentration). In addition, the water usage level defines the mechanical action of the process on the fabric, which is another significant performance parameter; this is the agitation of the cloth surface during washing, which plays a key role in releasing embedded soil. In aqueous processes, such mechanical action is provided by the water usage level in combination with the drum design for any particular washing machine. In general terms, it is found that the higher the water level in the drum, the better the mechanical action. Hence, there is a dichotomy created by the desire to improve overall process efficiency (i.e. the reduction of energy, water and detergent consumption), and the need for efficient mechanical action in the wash. For domestic washing in particular there are defined wash performance standards specifically designed to discourage the use of such higher levels of water in practice, in addition to the obvious cost penalties which are associated with such usage.

Current efficient domestic washing machines have made significant strides towards minimising their consumptions of energy, water and detergent. EU Directive 92/75/CEE sets a standard which defines washing machine energy consumption in kWh/cycle (cotton setting at 60° C.), such that an efficient domestic washing machine will typically consume <0.19 kWh/kg of washload in order to obtain an 'A' rating. If water consumption is also considered, then 'A' rated machines use <9.7 liters/kg of washload.

The most recent system in the EU (arising from Commission Delegated Regulation 1061/2010, introduced from 20 Dec. 2011) has, however, seen a switch to a new rating system for domestic washing machines. This considers annualised energy and water consumptions, and derives an energy efficiency index (EEI) based on a defined weekly set of wash cycles (3 off 60° C. at full load, 2 off 60° C. at half load, and 2 off 40° C. at half load). The total energy consumption of these washes (plus weighted values for the 'off mode' and 'left-on' mode power consumptions) is then averaged to a daily figure (by division by 7). The resulting figure is then multiplied by 220—the assumed average number of washes per annum, to calculate the annual energy consumption (AEc) in KWh. The EEI is then calculated by dividing the AEc by a standard annual energy consumption (SAEc=[47×c]+51.7), where c is the washload capacity for the machine. An EEI value of <46 results in an A+++ energy efficiency rating. A similar approach is taken with the water consumption to arrive at the AWc (the water consumption for the same weekly set of wash cycles, averaged to daily consumption and annualised). This value is, however, simply displayed as an annual consumption in liters/annum.

Detergent dosage is then driven by manufacturer recommendations but, again, in the domestic market, for a concentrated liquid formulation, a figure of 35 ml (or 37 g) for a 4-6 kg washload in soft and medium hardness water, increasing to 52 ml (or 55 g) for a 6-8 kg washload (or in hard water or for very dirty items) is typical (see, for example, Unilever pack dosage instructions for Persil® Small & Mighty). Hence, for a 4-6 kg washload in soft/medium water hardness, this equates to a detergent dosage of 7.4-9.2 g/kg whilst, for a 6-8 kg washload (or in hard water or for very dirty items), the range is 6.9-9.2 g/kg.

Energy, water and detergent consumptions in the industrial washing process (washer extractors) are considerably different, however, and usages of all three resources are less constrained, since these are principal factors in reducing cycle time—which is, of course, more of a consideration than in the case of domestic processes. For a typical industrial washer extractor (25 kg washload rated and above), energy consumption is >0.30 kWh/kg, water usage is at ~20 liters/kg, and detergent is much more heavily dosed than for domestic washing. The exact level of detergent used will depend on the amount of soiling, but a range of 18-70 g/kg is representative.

Thus, it can be taken from the above discussion that it is the performance levels in the domestic sector which set the highest standard for an efficient fabric washing process, and that these are: an energy consumption of <0.19 kWh/kg or an EEI of <46, a water usage of <9.7 liters/kg, and a detergent dosage of approximately 8.0 g/kg (8.5 ml/kg). However, as previously observed, it is becoming increasingly difficult to reduce the water (and, hence, energy and detergent) levels in a purely aqueous process, due to the minimum requirement to wet the fabric thoroughly, the need to provide sufficient excess water to suspend the soil removed in an aqueous liquor and, finally, the need to rinse the fabric.

Heating of the wash water is then the principal use of energy, and a minimum level of detergent often becomes necessary to improve cleaning performance. Means to improve mechanical action without increasing the water level used would, therefore, make any aqueous wash process significantly more efficient (i.e. yield further reductions in energy, water and detergent consumption). It should be noted that mechanical action itself has a direct effect on the detergent level, since the greater the level of soil removal which is achieved through physical force, the less that is required of the detergent chemistry. However, increasing the mechanical action in a purely aqueous washing process has certain associated drawbacks. Fabric creasing readily occurs in such processes, and this acts to concentrate the stresses from mechanical action at each crease, resulting in localised fabric damage. Prevention of such fabric damage (i.e. fabric care) is of primary concern to the domestic consumer and the industrial user.

In the light of these challenges which are associated with aqueous washing processes, the present inventors have previously devised a new approach to the problem, which allows the deficiencies demonstrated by the methods of the prior art to be overcome. The method which is provided eliminates the requirement for the use of large volumes of water, but is still capable of providing an efficient means of cleaning and stain removal, whilst also yielding economic and environmental benefits.

Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. Preferably, the substrate is wetted so as to achieve a substrate to water ratio of between 1:0.1 to 1:5 w/w, and optionally, the formulation additionally comprises at least one cleaning material, which typically comprises a surfactant, which most preferably has detergent properties. In preferred embodiments, the substrate comprises a textile fibre and the polymeric particles may, for example, comprise particles of polyamides, polyesters, polyalkenes, polyurethanes or their copolymers, but are most preferably in the form of nylon beads.

The use of this particle-based cleaning method, however, presents a requirement for the cleaning particles to be efficiently separated from the cleaned substrate at the conclusion of the cleaning operation, and this issue is addressed in WO-A-2010/094959, which provides a novel design of cleaning apparatus requiring the use of two internal drums capable of independent rotation, and which finds application in both industrial and domestic cleaning processes.

In WO-A-2011/064581, there is provided a further apparatus which facilitates efficient separation of cleaning particles from the cleaned substrate at the conclusion of the cleaning operation, and which comprises a perforated drum and a removable outer drum skin which is adapted to prevent the ingress or egress of fluids and solid particulate matter from the interior of the drum, the cleaning method requiring attachment of the outer skin to the drum during a wash cycle, after which the skin is removed prior to operating a separation cycle to remove the cleaning particles, following which the cleaned substrate is removed from the drum.

In a further development of the apparatus of WO-A-2011/064581, there is disclosed in WO-A-2011/098815 a process and apparatus which provides for continuous circulation of the cleaning particles during the cleaning process, and thereby dispenses with the requirement for the provision of an outer skin.

In WO-A-2012/056252 the polymeric particle-based cleaning method, and the separation of said cleaning particles from the cleaned substrate, are both further improved by careful control of polymeric particle size, shape and density, as well as process parameters. A cleaning process is achieved which facilitates excellent cleaning performance at surprisingly low cleaning temperatures (i.e. low energy), and with reduced levels of added detergents, whilst also maintaining the original low water consumption.

In a further development of the cleaning method of WO-A-2012/056252, a process has been developed which meets the previously discussed targets for savings in energy consumption, water usage and detergent dosage whilst also facilitating reduced localised fabric damage in the washed substrate by virtue of the increased uniformity of the mechanical action of the particles with the fabric surface. Thus, in WO-A-2012/095677, there is disclosed a method for the cleaning of a soiled substrate which allows for the use of non-polymeric cleaning particles, and comprises treating the substrate with the non-polymeric cleaning particles and wash water in an apparatus comprising a drum comprising perforated side walls. Thus, it has been established that the use of certain non-polymeric particles can enhance the mechanical action in the wash process such that, most particularly in combination with polymeric particles, there is a surprising benefit achieved in overall cleaning performance.

The apparatus and methods disclosed in the foregoing prior art documents have been highly successful in providing an efficient means of cleaning and stain removal which also yields significant economic and environmental benefits.

Even in view of the above-mentioned advancements there still remains a need for further improvements. The present invention attempts to solve, at least in part, one or more of the following problems, including: (i) maintaining the required amount of solid particulate material in the cage during cleaning, (ii) efficient separation of the solid particulate material after the cleaning steps, (iii) maintaining or improving cleaning performance, (iv) maintaining or improving fabric care, (v) maintaining or improving the cleaning efficiency per kg of dry substrate and (vi) providing a simpler more economic cleaning apparatus and method. In embodiments, the present invention at least partially solves these problems using an apparatus which is suited to the demands of both industrial and especially domestic cleaning. Such apparatus (e.g. washing machines) can typically comprise a perforated drum which is adapted to allow the ingress or egress of fluids from the interior of the drum, but wherein the perforations are of such as size as to prevent the ingress and egress of solid particulate matter therethrough. Consequently, the present invention provides an apparatus which comprises of a rotatably mounted cylindrical cage and a means of collecting and recycling solid particulate cleaning material therein and a cleaning method wherein the solid particulate cleaning material is released into the wash load during the wash cycle, and thereafter is collected and recycled within the rotatably mounted cylindrical cage during the wash cycle and subsequently collected and removed from the rotatably mounted cylindrical cage on completion of cleaning process.

The present invention also provides a cleaning method which allows for the continuous circulation of the cleaning particles (solid particulate material) during the cleaning process and their collection on completion of cleaning operations.

The apparatus and method of the present invention allow for improved control of bead (solid particulate material) recirculation during operation and facilitate the use of rotatably mounted cylindrical cages having smaller diameter perforations than are typical in apparatus of the prior art which, it is believed, offer additional benefits in domestic washing machines in terms of fabric care when compared with drums having larger perforations.

SUMMARY OF THE INVENTION

Thus, according to a first aspect of the present invention, there is provided an apparatus for use in the treatment of substrates using a solid particulate material, said apparatus comprising:

(a) housing means having:

(i) a first upper chamber having mounted therein a rotatably mounted cylindrical cage, and (ii) a second lower chamber located beneath said cylindrical cage;

(b) at least one recirculation means;

(c) access means;

(d) pumping means; and (e) a multiplicity of delivery means, wherein said rotatably mounted cylindrical cage additionally comprises collecting and transferring means, adapted to facilitate collection of said solid particulate material and transfer of said material to said at least one recirculation means.

In typical embodiments of the invention, said solid particulate material comprises a solid particulate cleaning material.

In certain embodiments of the invention, said rotatably mounted cylindrical cage comprises a drum comprising perforated side walls, wherein said perforations comprise holes having a diameter of no greater than 3.0 mm. Thus, said perforations permit the ingress and egress of fluids and fine particulate materials of lesser diameter than the holes, but are adapted so as to prevent the egress of said solid particulate material.

In alternative embodiments of the invention, said rotatably mounted cylindrical cage comprises a drum comprising solid side walls including no perforations such that, in operation, ingress and egress of any materials from the interior of the drum is only possible via said collecting and transferring means.

Typically, said collecting and transferring means comprises at least one receptacle comprising a first flow path facilitating ingress of fluids and solid particulate material from said rotatably mounted cylindrical cage and a second flow path facilitating transfer of said fluids and solid particulate material to said recirculation means.

In certain embodiments of the invention, said collecting and transferring means comprises one or a plurality of compartments.

In certain embodiments of the invention, said compartment or plurality of compartments may be located on at least one inner surface of said rotatably mounted cylindrical cage.

Embodiments of the invention envisage a plurality of compartments located, typically at equidistant intervals, on the inner circumferential surface of said rotatably mounted cylindrical cage.

In alternative embodiments of the invention, said plurality of compartments may be located on the inner end surface of said rotatably mounted cylindrical cage.

In operation, said solid particulate material enters the collecting and transferring means via a first flow path and is transferred to the recirculation means via a second flow path. Typically, said first flow path comprises a first aperture allowing ingress of fluids and solid particulate material into the collecting compartment of said collecting and transferring means and said second flow path comprises a second aperture allowing transfer of said fluids and solid particulate material to said repository of said at least one recirculation means.

Said second aperture typically comprises at least one orifice in the side wall of said rotatably mounted cylindrical drum, said at least one orifice having a diameter which allows said solid particulate material to transfer to said recirculation means. Said second aperture optionally additionally comprises regulating means, adapted to control the flow of solid particulate material from the collecting compartment to the storage means of said collecting and transferring means. Said regulating means may conveniently be provided in the form of an openable door or flap which is adapted to release said solid particulate material into said storage means.

In certain embodiments, said collecting and transferring means is adapted such that ingress of fluids and solid particulate material may be controlled by the direction of rotation of said rotatably mounted cylindrical cage. Thus, in embodiments of the invention wherein said collecting and transferring means comprises at least one compartment comprising a flow path facilitating ingress of fluids and solid particulate material and transfer of said fluids and solid particulate material to said recirculating means, said ingress is dependent on said direction of rotation; subsequent transfer of said solid particulate material to said recirculation means is optionally controlled by said regulating means.

The present invention also envisages apparatus wherein said collecting and transferring means is retrofitted to apparatus of the prior art.

Said access means typically comprises a hinged door mounted in the casing, which may be opened to allow access to the inside of the cylindrical cage, and which may be closed in order to provide a substantially sealed system. Typically, the door includes a window. Optionally, said door also includes at least one addition port which facilitates the addition of materials to said rotatably mounted cylindrical cage.

Said rotatably mounted cylindrical cage may be mounted vertically within said housing means but, more generally, is mounted horizontally within said housing means. Consequently, in typical embodiments of the invention, said access means is located in the front of the apparatus, providing a front-loading facility. When the rotatably mounted cylindrical cage is vertically mounted within the housing means, the access means is located in the top of the apparatus, providing a top-loading facility. However, for the purposes of the further description of the present invention, it will be assumed that said rotatably mounted cylindrical cage is mounted horizontally within said housing means.

Rotation of said rotatably mounted cylindrical cage is effected by use of drive means, which typically comprises electrical drive means, in the form of an electric motor. Operation of said drive means is effected by control means which may be programmed by an operative.

Said rotatably mounted cylindrical cage is of the size which is to be found in most commercially available washing machines and tumble driers, and may have a capacity in the region of 10 to 7000 liters. Particular embodiments of the invention are concerned with domestic washing machines wherein a typical capacity would be in the region of 30 to 120 liters. However, other embodiments of the invention relate to industrial washer-extractors, wherein capacities anywhere in the range of from 120 to 7000 liters are possible. In the context of the cleaning of soiled substrates, a typical size in this range is that which is suitable for a 50 kg washload, wherein the drum has a volume of 450 to 650 liters and, in such cases, said cage would generally comprise a cylinder with a diameter in the region of 75 to 120 cm, typically from 90 to 110 cm, and a length of between 40 and 100 cm, typically between 60 and 90 cm. Generally, the cage will have 10 liters of volume per kg of washload to be cleaned.

In typical embodiments of the invention, said apparatus is designed to operate in conjunction with soiled substrates and cleaning media comprising a solid particulate material, which is most preferably in the form of a multiplicity of polymeric particles or a mixture of polymeric and non-polymeric particles. These particles are preferably required to be efficiently circulated (within the drum itself) to promote effective cleaning and the apparatus, therefore, optionally includes circulation means for this purpose. Thus, the inner surface of the cylindrical side walls of said rotatably mounted cylindrical cage typically comprises circulation means in the form of a multiplicity of spaced apart elongated protrusions affixed essentially perpendicularly to said inner surface. Typically said apparatus comprises from 3 to 10, most preferably 4, of said protrusions, which are commonly referred to as lifters. In operation, agitation of the contents of the rotatably mounted cylindrical cage is provided by the action of said lifters on rotation of said cage.

Particular embodiments of the invention envisage an apparatus as hereinbefore defined wherein said collecting and transferring means comprises a plurality of compartments located at equidistant intervals on the inner circumferential surface of said rotatably mounted cylindrical cage. In said embodiments, said plurality of compartments thereby additionally functions as a plurality of lifters.

Thus, in said embodiments, said lifters are adapted so as to collect said solid particulate material and to facilitate controlled transfer of solid particulate material between said lifter/collecting/transferring means and said at least one recirculation means. Most typically, said apparatus comprises a collecting compartment of essentially equal length to said lifter, and adapted so as to provide a first flow path from the compartment through an aperture in said lifter to the inside of said cage. Thus, in operation, for a given direction of rotation of said cage, particulate material present on the inner surface of said cage enters the lifters through the aperture and transports to the compartment housed therein via the first flow path; when the direction of rotation of said drum is reversed, entry of the solid particulate material into the compartment does not occur, or occurs to a lesser extent. Typically, said first flow path comprises a first aperture allowing ingress of solid particulate material into said capturing compartment and said second flow path comprises a second aperture allowing transfer of said solid particulate material to said at least one recirculation means. The dimensions of the apertures are selected in line with the dimensions of the solid particulate material, so as to allow efficient ingress and transfer thereof.

Said rotatably mounted cylindrical cage is located within a first upper chamber of said housing means and beneath said first upper chamber is located a second lower chamber which typically comprises a repository for said solid particulate material transferred from said collecting and transferring means from which said solid particulate material is recirculated to said rotatably mounted cylindrical cage. Typically, said lower chamber comprises a sump, which is typically an enlarged sump.

Said housing means is connected to standard plumbing features, thereby providing at least one recirculation means, in addition to a multiplicity of delivery means, by virtue of which at least water and, optionally, cleaning agents such as surfactants may be introduced into the apparatus. Said apparatus may additionally comprise means for circulating air within said housing means, and for adjusting the temperature and humidity therein. Said means may typically include, for example, a recirculating fan, an air heater, a water atomiser and/or a steam generator. Additionally, sensing means may also be provided for determining, inter alia, the temperature and humidity levels within the apparatus, and for communicating this information to the control means.

Thus, said apparatus comprises at least one recirculation means, thereby facilitating recirculation of said solid particulate material from said collecting and transferring means to said rotatably mounted cylindrical cage, for re-use in cleaning operations. Typically, a first recirculation means comprises ducting connecting said second lower chamber and said rotatably mounted cylindrical cage. More typically, said ducting comprises separating means for separating said solid particulate material from water and control means, adapted to control entry of said solid particulate material into said cylindrical cage. In embodiments of the invention, said separating means comprises a filter material such as wire mesh located in a receptor vessel above said cylindrical cage, and said control means comprises a valve located in feeder means, preferably in the form of a feed tube attached to said receptor vessel, and connected to the interior of the cylindrical cage.

In said embodiments, recirculation of solid particulate matter from said lower chamber to said rotatably mounted cylindrical cage is achieved by the use of pumping means comprised in said first recirculation means, wherein said pumping means is adapted to deliver said solid particulate matter to said separating means and said control means, adapted to control the re-entry of said solid particulate matter into said rotatably mounted cylindrical cage.

Optionally, said apparatus additionally includes a second recirculation means, allowing for the return of water separated by said separating means to said lower chamber, thereby facilitating re-use of said water in an environmentally beneficial manner.

Optionally, said lower chamber comprises additional pumping means to promote circulation and mixing of the contents thereof, in addition to heating means, allowing the contents to be raised to a preferred temperature of operation.

Optionally, said apparatus comprises a stationary member which is located adjacent said rotatably mounted cylindrical cage and comprises a multiplicity of delivery means mounted thereon, wherein said multiplicity of delivery means is adapted to facilitate the delivery of materials into said rotatably mounted cylindrical cage.

In embodiments of the invention, said delivery means may comprise spraying means, typically in the form of a spray head, which facilitates better distribution of materials delivered into said rotatably mounted cylindrical cage.

In operation, during a typical cycle for cleaning of a soiled substrate in an apparatus wherein said collecting and transferring means is comprised in said lifters, soiled garments are first placed into said rotatably mounted cylindrical cage. Then, the necessary amount of water, together with any required additional cleaning agent, are added to said rotatably mounted cylindrical cage, followed by the solid particulate material. Optionally, said materials are heated to the desired temperature in the lower chamber comprised in the housing means and introduced, via the first recirculation means, into the cylindrical cage. Alternatively, said cleaning agent may, for example, be pre-mixed with water and added either via an addition port mounted on the access means or through said separating means located above said cylindrical cage. Optionally, this water may be heated. Additional cleaning agents, of which either an oxygen or chlorine based bleach is a typical example, may be added with more, optionally heated, water at later stages during the wash cycle, using the same means.

During the course of agitation by rotation of the cage, the fluids and a quantity of the solid particulate material enter the collecting and transferring means via said first flow paths and are transferred via said second flow paths to the repository located in the lower chamber of the apparatus which comprises the first section of the first recirculation means. Thereafter, the solid particulate material may be recirculated, via said first recirculation means, such that it is transferred to said separating means, from which it is returned, in a manner controlled by said control means, to the cylindrical cage for continuation of the washing operation. This process of continuous circulation of the solid particulate material continues throughout the washing operation until cleaning is completed.

Thus, the solid particulate material which is collected in the collecting and transferring means in said rotatably mounted cylindrical cage and transferred to said recirculation means is carried to the top side of said rotatably mounted cylindrical cage, wherein it is caused, by means of gravity, to fall through said separation means and, by operation of control means, through said feeder means and back into said cage, thereby to continue the cleaning operation.

The collection of said solid particulate material is controlled by the rotation of said rotatably mounted cylindrical cage which commences rotation in a pre-determined direction. Thus, by means of cage rotation and gravity, solid particulate cleaning material moves relative to said lifters/collecting/transferring compartments along the first flow paths such that, for each rotation of said cylindrical cage, a volume of solid particulate material is collected in said lifters, via the apertures in the lifters. After collection in these compartments, the solid particulate material is able to flow, under the influence of gravity, along said second flow paths and, thereby, to said recirculation means for subsequent re-introduction into said rotatably mounted cylindrical cage for continuation of cleaning operations. Optionally, said flow of material along said second flow paths is controlled by said regulating means.

According to a second aspect of the present invention, there is provided a method for treating a substrate, said method comprising the treatment of the substrate with a formulation comprising solid particulate material, wherein said method is carried out in an apparatus according to the first aspect of the invention. For methods wherein the treatment is a cleaning treatment, the substrate can comprise at least one soiled substrate and, in typical embodiments, the at least one soiled substrate comprises at least one textile fibre, which is preferably in the form of a garment. More particularly, in embodiments of the invention, said method comprises the cleaning of a soiled substrate with a formulation comprising solid particulate cleaning material and wash water, wherein said method is carried out in an apparatus according to the first aspect of the invention.

Typically, said method comprises the steps of:

(a) introducing a solid particulate cleaning material and water into the second lower chamber of an apparatus according to the first aspect of the invention;

(b) agitating and heating said solid particulate cleaning material and water;

(c) loading at least one soiled substrate into said rotatably mounted cylindrical cage via access means;

(d) closing the access means so as to provide a substantially sealed system;

(e) introducing said water and solid particulate cleaning material into said rotatably mounted cylindrical cage via recirculating means;

(f) operating the apparatus for a wash cycle, wherein said rotatably mounted cylindrical cage is caused to rotate and wherein fluids and solid particulate cleaning material are caused to enter collecting and transferring means via first flow paths to be transferred along second flow paths to said recirculating means in a controlled manner;

(g) operating pumping means so as to transfer fresh solid particulate cleaning material and recycle used solid particulate cleaning material via said recirculating means to separating means;

(h) operating control means so as to add said fresh and recycled solid particulate cleaning material to said rotatably mounted cylindrical cage in a controlled manner; and (i) continuing with steps (e), (f), (g) and (h) as required to effect cleaning of the soiled substrate.

Typically, additional cleaning agents are employed in said method. Preferably, at least one (additional) cleaning agent is added to the apparatus according to the first aspect of the invention. Said, additional cleaning agents are typically pre-mixed with water and the mixture is optionally heated prior to addition to said cylindrical cage via delivery means or an addition port located on said access means. In certain embodiments of the invention, said addition may be effected via spraying means, such as a spray head, in order to better distribute said cleaning agents in the washload.

The generation of suitable G forces, in combination with the action of the solid particulate cleaning material, is a key factor in achieving an appropriate level of cleaning of the soiled substrate. G is a function of the cage size and the speed of rotation of the cage and, specifically, is the ratio of the centripetal force generated at the inner surface of the cage to the static weight of the washload. Thus, for a cage of inner radius r (m), rotating at R (rpm), with a washload of mass M (kg), and an instantaneous tangential velocity of the cage v (m/s), and taking g as the acceleration due to gravity at 9.81 m/s$^2$:

$$\text{Centripetal force}=Mv^2/r$$

$$\text{Washload static weight}=Mg$$

$$v=2\pi rR/60$$

$$\text{Hence, } G=4\pi^2r^2R^2/3600rg=4\pi^2rR^2/3600g=1.118\times 10^{-3}rR^2$$

When, as is usually the case, r is expressed in centimeters, rather than meters, then:

$$G=1.118\times10^{-5}rR^2$$

Hence, for a drum of radius 49 cm rotating at 800 rpm, G=350.6.

In a particular embodiment of the invention, a cylindrical drum having a diameter of 98 cm is rotated at a speed of 30-800 rpm in order to generate G forces of 0.49-350.6 at different stages during the cleaning process. In examples of alternative embodiments of the invention, a 48 cm diameter drum rotating at 1600 rpm can generate 687 G, whilst a 60 cm diameter drum at the same speed of rotation generates 859 G.

In typical embodiments of the invention, the claimed method additionally provides for separation and recovery of the solid particulate cleaning material, and this may then be re-used in subsequent washes.

During the wash cycle, rotation of said rotatably mounted cylindrical cage is preferably caused to occur at rotation speeds such that G is <1 which, for a 98 cm diameter cage, requires a rotation speed of up to 42 rpm, with preferred rates of rotation being between 30 and 40 rpm.

Typically, on completion of the wash cycle, rotation of said rotatably mounted cylindrical cage can be caused to occur at a G force of less than 1 so as to allow for removal of the solid particulate cleaning material, preferably to the storage means. On completion of the wash cycle, the speed of rotation of the cage can initially be increased in order to effect a measure of drying of the cleaned substrate, thereby generating G forces of between 10 and 1000, more specifically between 40 and 400. Typically, for a 98 cm diameter cage, rotation is at a speed of up to 800 rpm in order to achieve this effect. Subsequently, rotation speed is reduced and returned to the speed of the wash cycle so as to allow for removal of said solid particulate cleaning material.

Optionally, following said solid particulate material collection operation, said method may additionally comprise a rinsing operation, wherein additional water may be added to said rotatably mounted cylindrical cage, preferably in order to effect complete removal of any additional cleaning agent employed in the cleaning operation. Water may be added to said cylindrical cage via said delivery means or said addition port mounted on said access door. Again, addition may optionally be carried out by means of a spray head in order to achieve better distribution of the rinsing water in the washload. Alternatively, said addition may be achieved by overfilling the second, lower chamber of said apparatus with water such that it enters the first, upper chamber and thereby partially submerges said rotatably mounted cylindrical cage and enters into said cage. Following rotation at the same speed as during the wash cycle, water is removed from said cage by allowing the water level to fall as appropriate and, whatever method of rinse water addition is employed, the speed of rotation of the cage is then increased so as to achieve a measure of drying of the substrate. Typically, for a 98 cm diameter cage, rotation is at a speed of up to 800 rpm in order to achieve this effect. Subsequently, rotation speed is reduced and returned to the speed of the wash cycle, thereby allowing for final collection of any remaining solid particulate cleaning material. Said rinsing and drying cycles may be repeated as often as desired.

Optionally, said rinse cycle may be used for the purposes of substrate treatment, involving the addition of treatment agents such as anti-redeposition additives, optical brighteners, perfumes, softeners and starch to the rinse water.

Said solid particulate cleaning material is optionally subjected to a cleaning operation in said lower chamber by sluicing said chamber with clean water in the presence or absence of a cleaning agent, such as a surfactant. Optionally, this water may be heated. Alternatively, cleaning of the solid particulate cleaning material may be achieved as a separate stage in said rotatably mounted cylindrical cage, again using water which may optionally be heated.

Generally, any remaining solid particulate cleaning material on said at least one substrate may be easily removed by shaking the at least one substrate. If necessary, however, further remaining solid particulate cleaning material may be removed by suction means, preferably comprising a vacuum wand.

BRIEF DESCRIPTION OF THE DRAWINGS

The invention will now be further illustrated by reference to the following drawings, wherein.

DETAILED DESCRIPTION OF THE INVENTION

Figure 1:
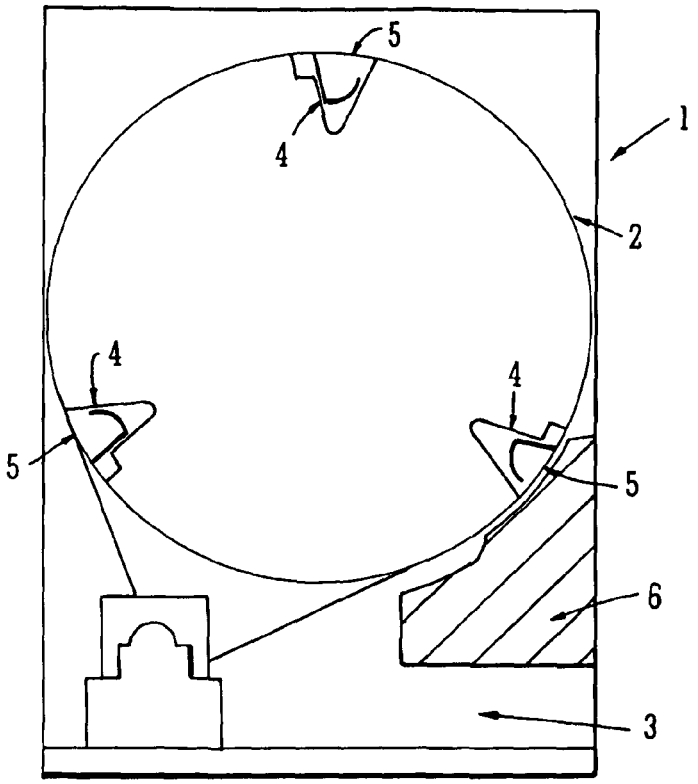
FIG. 1 shows an apparatus according to an embodiment of the invention.

The apparatus according to the invention may be used for the treatment of any of a wide range of substrates including, for example, plastics materials, leather, paper, cardboard, metal, glass or wood. In practice, however, said apparatus is principally designed for use in the cleaning of substrates comprising a textile fibre comprised in such as textile fibre garments, and has been shown to be particularly successful in achieving efficient cleaning of textile fibres which may, for example, comprise either natural fibres, such as cotton, or man-made and synthetic textile fibres, for example nylon 6,6, polyester, cellulose acetate, or fibre blends thereof.

Most preferably, the solid particulate cleaning material comprises a multiplicity of polymeric particles or a mixture of polymeric particles and non-polymeric particles. The particles are of such a shape and size as to allow for good flowability and intimate contact with the soiled substrate. A variety of shapes of particles can be used, such as cylindrical, spherical or cuboid; appropriate cross-sectional shapes can be employed including, for example, annular ring, dog-bone and circular. Non-polymeric particles comprising naturally occurring materials such as stone may have various shapes, dependent on their propensity to cleave in a variety of different ways during manufacture. Most preferably, however, said particles comprise cylindrical or spherical beads.

The polymeric particles may comprise either foamed or unfoamed polymeric materials. Furthermore, the polymeric particles may comprise polymers which are either linear or crosslinked.

The polymeric particles typically comprise polyalkenes such as polyethylene and polypropylene, polyamides, polyesters or polyurethanes. More particularly, however, said polymeric particles comprise polyamide or polyester particles, most particularly particles of nylon, polyethylene terephthalate or polybutylene terephthalate, typically in the form of beads. Said polyamides and polyesters are found to be particularly effective for aqueous stain/soil removal, whilst polyalkenes are especially useful for the removal of oil-based stains.

Various nylon or polyester homo- or co-polymers may be used including, but not limited to, Nylon 6, Nylon 6,6, polyethylene terephthalate and polybutylene terephthalate. Preferably, the nylon comprises Nylon 6,6 polymer, typically having a molecular weight in the region of from 5000 to 30000 Daltons, more typically from 10000 to 20000 Daltons, most typically from 15000 to 16000 Daltons. The polyester will typically have a molecular weight corresponding to an intrinsic viscosity measurement in the range of from 0.3-1.5 dl/g as measured by a solution technique such as ASTM D-4603.

Optionally, copolymers of the above polymeric materials may be employed for the purposes of the invention. Specifically, the properties of the polymeric materials may be tailored to specific requirements by the inclusion of monomeric units which confer particular properties on the copolymer. Thus, the copolymers may be adapted to attract particular staining materials by comprising monomers which, inter alia, are ionically charged, or include polar moieties or unsaturated organic groups.

The non-polymeric particles may comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium, tin and lead, and alloys thereof. Suitable ceramics include, but are not limited to, alumina, zirconia, tungsten carbide, silicon carbide and silicon nitride.

In further embodiments of the invention, said non-polymeric particles may comprise coated non-polymeric particles. Most particularly, said non-polymeric particles may comprise a non-polymeric core material and a shell comprising a coating of a polymeric material. In a particular embodiment, said core may comprise a metal core, typically a steel core, and said shell may comprise a polyamide coating, for example a coating of nylon.

It has been established that the combination of particle size, shape and density is such that the mechanical action of the particle with the fabric is optimised, it being sufficiently vigorous to provide effective cleaning but, at the same time, uniform and gentle enough to reduce fabric damage when compared with conventional aqueous processes. It is, in particular, the uniformity of the mechanical action generated by the chosen particles across the entire fabric surface that is the key factor in this regard. The particle parameters are also controlled so as to allow for easy separation of the particles from the fabric washload at the end of the wash process. Thus, particle size and shape may be controlled in order to minimise entanglement with the fabric, and the combination of suitable particle density with low G (<1) and high free volume in the washing machine tumbling process together promote particle removal from the fabric on completion of the wash process.

All particles may have smooth or irregular surface structures and can be of solid or hollow construction. Non-polymeric particles typically have an average density in the range of from 3.5-12.0 g/cm$^3$, more typically from 5.0-10.0 g/cm$^3$, most typically from 6.0-9.0 g/cm$^3$. Polymeric particles typically have an average density in the range of 0.5-2.5 g/cm$^3$, more typically from 0.55-2.0 g/cm$^3$, most typically from 0.6-1.9 g/cm$^3$. The average volume of both the non-polymeric and polymeric particles is typically in the range of 5-275 mm$^3$, more typically from 8-140 mm$^3$, most typically from 10-120 mm$^3$.

In the case of cylindrical particles—both non-polymeric and polymeric—of oval cross section, the major cross section axis length, a, is typically in the range of from 2.0-6.0 mm, more typically from 2.2-5.0 mm, most typically from 2.4-4.5 mm, and the minor cross section axis length, b, is typically in the range of from 1.3-5.0 mm, more typically from 1.5-4.0 mm, and most typically from 1.7-3.5 mm (a>b). The length of such particles, h, is typically from 1.5-6.0 mm, more typically from 1.7-5.0 mm, and most typically from 2.0-4.5 mm (h/b is typically in the range of from 0.5-10).

For cylindrical particles—both non-polymeric and polymeric—of circular cross section, the typical cross section diameter, $d_c$, is in the range of from 1.3-6.0 mm, more typically from 1.5-5.0 mm, and most typically from 1.7-45.5 mm. The typical length, $h_c$, of such particles is again from 1.5-6.0 mm, more typically from 1.7-5.0 mm, and most typically from 2.0-4.5 mm ($h_c/d_c$ is typically in the range of from 0.5-10).

In the case of both non-polymeric and polymeric spherical particles (not perfect spheres) the diameter, $d_s$, is typically in the range of from 2.0-8.0 mm, more typically in the range of from 2.2-5.5 mm, and most typically from 2.4-5.0 mm.

In embodiments where the particles, whether non-polymeric or polymeric, are perfect spheres, the diameter, $d_{ps}$, is typically in the range of from 2.0-8.0 mm, more typically from 3.0-7.0 mm, and most typically from 4.0-6.5 mm.

The selection of specific particle type (polymeric and non-polymeric, when used) for a given cleaning operation is particularly significant in optimising fabric care. Thus, particle size, shape, mass and material must all be considered carefully in respect of the particular substrate which is to be cleaned, so that particle selection is dependent on the nature of the garments to be cleaned, i.e. whether they comprise cotton, polyester, polyamide, silk, wool, or any of the other common textile fibres or blends which are commonly in use.

In order to provide additional lubrication to the cleaning system and thereby improve the transport properties within the system, water is added to the system. Thus, more efficient transfer of the at least one cleaning material to the substrate is facilitated, and removal of soiling and stains from the substrate occurs more readily. Optionally, the soiled substrate may be moistened by wetting with mains or tap water prior to loading into the apparatus of the invention. In any event, water is added to the rotatably mounted cylindrical cage of the apparatus according to the invention such that the washing treatment is carried out so as to achieve a water to substrate ratio which is typically between 2.5:1 and 0.1:1 w/w; more typically, the ratio is between 2.0:1 and 0.8:1, with particularly favourable results having been achieved at ratios such as 1.75:1, 1.5:1, 1.2:1 and 1.1:1. Most conveniently, the required amount of water is introduced into the rotatably mounted cylindrical cage of the apparatus according to the invention after loading of the soiled substrate into said cage.

Whilst, in one embodiment, the method of the invention envisages the cleaning of a soiled substrate by the treatment of a moistened substrate with a formulation which essentially consists only of a multiplicity of polymeric particles or a multiplicity of polymeric and non-polymeric particles in the absence of any further additives, optionally in other embodiments the formulation employed may additionally comprise at least one cleaning agent. Said at least one cleaning agent may typically comprise at least one detergent composition. Optionally, said at least one cleaning agent is mixed with said polymeric particles or mixture of polymeric and non-polymeric particles but, in a particular embodiment, each of said polymeric particles is coated with said at least one cleaning agent.

The principal components of the detergent composition comprise cleaning components and post-treatment components. Typically, the cleaning components comprise surfactants, enzymes and bleach, whilst the post-treatment components include, for example, anti-redeposition additives, perfumes and optical brighteners.

However, the detergent formulation may optionally include one or more other additives such as, for example builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and/or pigments.

Examples of suitable surfactants may be selected from non-ionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

The compositions may include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof. A typical combination may comprise a mixture of enzymes such as protease, lipase, cutinase and/or cellulase in conjunction with amylase.

Optionally, enzyme stabilisers may also be included amongst the cleaning components. In this regard, enzymes for use in detergents may be stabilised by various techniques, for example by the incorporation of water-soluble sources of calcium and/or magnesium ions in the compositions.

The compositions may include one or more bleach compounds and associated activators. Examples of such bleach compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. Bleach activators include, but are not limited to, carboxylic acid esters such as tetraacetylethylenediamine and sodium nonanoyloxybenzene sulphonate.

Suitable builders may be included in the formulations and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The compositions may also optionally contain one or more copper, iron and/or manganese chelating agents and/or one or more dye transfer inhibiting agents.

Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent formulations can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives are physico-chemical in their action and include, for example, materials such as polyethylene glycol, polyacrylates and carboxy methyl cellulose.

Optionally, the compositions may also contain perfumes Suitable perfumes are generally multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1]benzofuran). One example of a commercially available fully formulated perfume is Amour Japonais supplied by Symrise® AG.

Suitable optical brighteners fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl)thiophene.

Said agents may be used either alone or in any desired combination and may be added to the cleaning system at appropriate stages during the cleaning cycle in order to maximise their effects.

In any event, however, when the method of the invention is performed in the presence of at least one additional cleaning agent, the quantity of said cleaning agent required in order to achieve satisfactory cleaning performance is significantly reduced from the quantities required with the methods of the prior art.

The ratio of solid particulate cleaning material to substrate is generally in the range of from 0.1:1 to 10:1 w/w, more typically in the region of from 0.5:1 to 5:1 w/w, with particularly favourable results being achieved with a ratio of between 1:1 and 3:1 w/w, and especially at around 2:1 w/w. Thus, for example, for the cleaning of 5 g of fabric, 10 g of polymeric particles, optionally coated with surfactant, would be employed in one embodiment of the invention. The ratio of solid particulate cleaning material to substrate is maintained at a substantially constant level throughout the wash cycle.

The apparatus and the method of the present invention may be used for either small or large scale batchwise processes and find application in industrial and, most particularly, domestic cleaning processes. By small scale in this context is typically meant less than or equal to 220 washing cycles per year, whilst large scale typically means more than 220 washing cycles per year.

As previously noted, the method of the invention finds particular application in the cleaning of textile fibres. The conditions employed in such a cleaning system do, however, allow the use of significantly reduced temperatures from those which typically apply to the conventional wet cleaning of textile fabrics and, as a consequence, offer significant environmental and economic benefits. Thus, typical procedures and conditions for the wash cycle require that fabrics are generally treated according to the method of the invention at, for example, temperatures of between 5 and 95° C., typically for a duration of between 5 and 120 minutes in a substantially sealed system. Thereafter, additional time is required for the completion of the rinsing and bead separation stages of the overall process, so that the total duration of the entire cycle is typically in the region of 1 hour. The preferred operating temperatures for the method of the invention are in the range of from 10 to 60° C. and, more preferably, from 15 to 40° C.

The cycle for collection and transfer of solid particulate material may optionally be performed at room temperature and it has been established that optimum results are achieved at cycle times of between 2 and 30 minutes, preferably between 5 and 20 minutes.

The washing performance results obtained are very much in line with those observed when carrying out conventional wet (or dry) cleaning procedures with textile fabrics. The extent of cleaning and stain removal achieved with fabrics treated by the apparatus and method of the invention is seen to be very good, with particularly outstanding results being achieved in respect of hydrophobic stains and aqueous stains and soiling, which are often difficult to remove. The energy requirement, the total volume of water used, and the detergent consumption of the method of the invention are all significantly lower than those levels associated with the use of conventional aqueous washing procedures, again offering significant advantages in terms of cost and environmental benefits.

The apparatus and method of the invention also show benefits in terms of reducing washing-related fabric damage. As previously observed, fabric creasing readily occurs in conventional aqueous washing, and this acts to concentrate the stresses from the mechanical action of the wash at each crease, resulting in localised fabric damage. Prevention of such fabric damage (or fabric care) is of primary concern to the domestic consumer and industrial user. The use of polymeric particles, or mixtures of non-polymeric and polymeric particles, according to the method of the invention effectively reduces creasing in the wash by acting as a pinning layer on the fabric surface in order to help prevent the folding action. The particles also inhibit interaction between separate pieces of fabric in the wash by acting as a separation or spacing layer, thereby reducing entanglement which is another major cause of localised fabric damage. In the presently disclosed method, mechanical action is still present but, critically, this is much more uniformly distributed as a result of the action of the particles. It is the localised aspect of the damage that determines the lifetime of a garment under multiple washing.

The apparatus and method of the present invention provide additional benefits in terms of fabric care by providing for the use of a rotatably mounted cylindrical cage having either no perorations, or perforations comprising holes with a diameter of no greater than 3.0 mm, whereas the prior art discloses the use of drums having much larger perforations, with the attendant problems in terms of fabric damage. Such disadvantages are typically associated with domestic machines, wherein the higher spin speeds of the rotatably mounted cylindrical cage result in the generation of higher G forces, thereby causing the substrates to be forced into the drum perforations, with the potential for trapping against the outer casing comprised in the housing means. Furthermore, additional damage can result from the removal stress encountered after compression into these perforations. Deleterious effects such as these can, however, be avoided by the use of the apparatus and method of the present invention.

Additionally, it has been demonstrated that re-utilisation of the polymeric and non-polymeric particles is possible, allowing for the performance of multiple washes with the same solid particulate cleaning material. Re-use of the particles in this way for repeat cleaning procedures provides significant economic benefits and satisfactory results are achieved after multiple washes, although it generally found that some deterioration in performance is eventually observed.

As previously disclosed, the apparatus of the present invention comprises collecting and transferring means adapted so as to collect solid particulate material and to facilitate controlled transfer of said solid particulate material between said collecting and transferring means and said at least one recirculation means. Said recirculating means typically includes a repository for said solid particulate material which is located in the second lower chamber of said housing means.

Said solid particulate material enters the collecting and transferring means via a first flow path and is transferred to the recirculation means via a second flow path. Typically, said first flow path comprises a first aperture allowing ingress of fluids and solid particulate material into the collecting compartment of said collecting and transferring means and said second flow path comprises a second aperture allowing transfer of said fluids and solid particulate material to said repository of said at least one recirculation means.

In certain embodiments of the invention, said second aperture additionally comprises regulating means, adapted to control the flow of solid particulate material from the collecting compartment to the storage means of said collecting and transferring means. Said regulating means may conveniently be provided in the form of an openable door or flap which is adapted to release said solid particulate material into said storage means.

In certain embodiments of the invention, said door or flap may be caused to open and release said solid particulate cleaning material into said storage means by actuation means, typically comprising mechanical, electrical or magnetic means. Thus, for example, said door or flap may incorporate a protrusion which interacts with said storage means during the course of rotation of the rotatably mounted cylindrical cage to cause the door or flap to open. Typically in such cases, said door or flap would comprise, for example, spring loading to hold the door in the closed position, until the protrusion abuts the storage means and the consequent interaction provides a force to act against the action of the spring, thereby causing the door to open. Once the interaction of the protrusion with the storage means ceases, as rotation of the cage continues, the force is removed and the door or flap returns to the closed position. Clearly, when the solid particulate material will naturally fall under gravity into the repository of the recirculating means when the regulating means is in the open position.

In further embodiments of the invention, said regulating means may be provided in the form of a revolving door which is adapted to release said solid particulate material into said recirculation means. In said embodiments, said door typically comprises two intersecting rigid members in the form of a cross incorporating a pin or other suitable member, inserted along the plane of intersection of the rigid members, and about which rotation of the door may occur. Said door is typically mounted in the surface of the rotatably mounted cylindrical cage and is caused to open and close by said actuating means which may optionally, for example, comprise mechanical means involving interaction with the recirculation means, located externally of the drum, during rotation of said drum, thereby causing said solid particulate material to be released from said drum and transferred to said recirculation means.

As previously stated, the invention also envisages embodiments wherein said solid particulate material is able to be transferred directly to said recirculation means without the requirement for regulating means.

Once transferred to the recirculation means, the solid particulate material is available to be conveyed back to the inside of the rotatably mounted cylindrical cage so as to reintroduce said material into the cage in the manner previously described.

According to the method of the invention, rotation of the rotatably mounted cylindrical cage in a specified direction for a period (typically 20 minutes) at the same low rpm of the washload (40 rpm; G<1) allows the bulk of the solid particulate cleaning material to leave the substrate to the outer wall of the cage and be collected via the collecting and transferring means. The rate of collection of the solid particulate cleaning material from the substrate into the recirculation means is affected by the speed of rotation of said cage, with higher rotation speeds increasing the centripetal force, so as to increase the tendency to push the solid particulate cleaning material out of the substrate and onto the cage outer walls. However, higher cage rpm values also compress the substrate being cleaned, so as to trap the cleaning material within folds thereof. The most suitable rotation speeds are, therefore, generally found to be between 40 and 50 rpm for a cage of 48 cm diameter. Furthermore, it is observed that the moisture level in the wash is also significant in controlling bead egress.

The method of the invention has been shown to be particularly successful in the removal of cleaning material from the cleaned substrate after washing during tests with nylon beads comprising spherical Nylon 6,6 polymer.

Following said bead removal operation a series of rinses is typically carried out, wherein additional water is sprayed into the rotatably mounted cylindrical cage in order to effect complete removal of any additional cleaning agent employed in the cleaning operation. Most advantageously, a spray head is used, and this may be mounted in an addition port on the access door. The use of such a spray head has been shown to better distribute the rinsing water in the washload and, by this means, the overall water consumption during the rinsing operation can also be minimised (3:1 rinse water:cloth, typically, per rinse).

The cage is again rotated at low speeds during rinse water addition (30-40 rpm, G=0.49-0.88 for 98 cm diameter cage) but, after this operation has ceased, the cage speed is once again increased to achieve a measure of drying of the substrate (300-800 rpm, G=49.3-350.6). Subsequently, rotation speed is reduced and returned to the speed of the wash cycle so as to allow for final removal of any remaining solid particulate cleaning material. Said rinsing and drying cycles may be repeated as often as desired, with three repetitions being typical.

Referring now to the Figures, there is seen in FIG. 1 an apparatus according to the invention comprising housing means (1) having a first upper chamber having mounted therein a rotatably mounted cylindrical cage in the form of drum (2) and a second lower chamber comprising a sump (3) located beneath said cylindrical cage. The apparatus additionally comprises collecting and transferring means comprising lifters (4) having regulating means in the form of doors (5) in a second flow path through which solid particulate material enters the repository (6) of the recirculation means, from which the solid particulate material may be returned to the interior of the rotatably mounted cylindrical cage by recirculation means (not shown).

Figure 2:
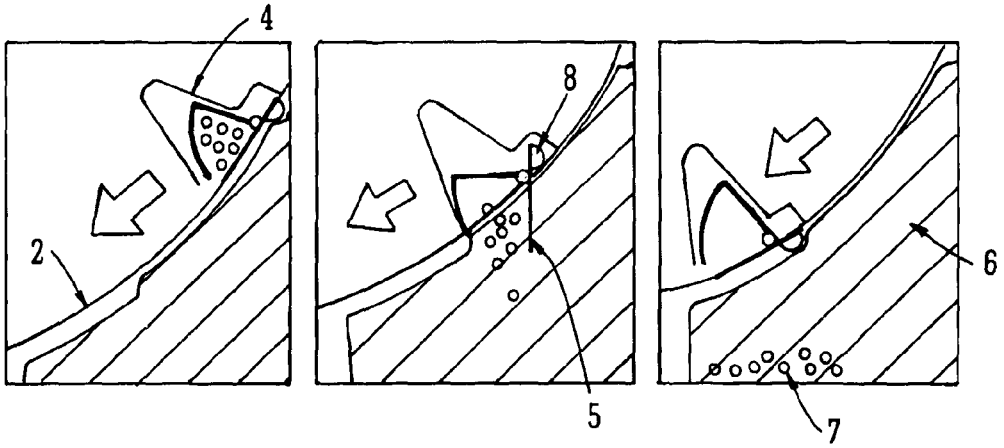
FIG. 2 shows the mode of operation of a particular embodiment of collection and transferring means comprised in the apparatus of the invention.
Figure 3:
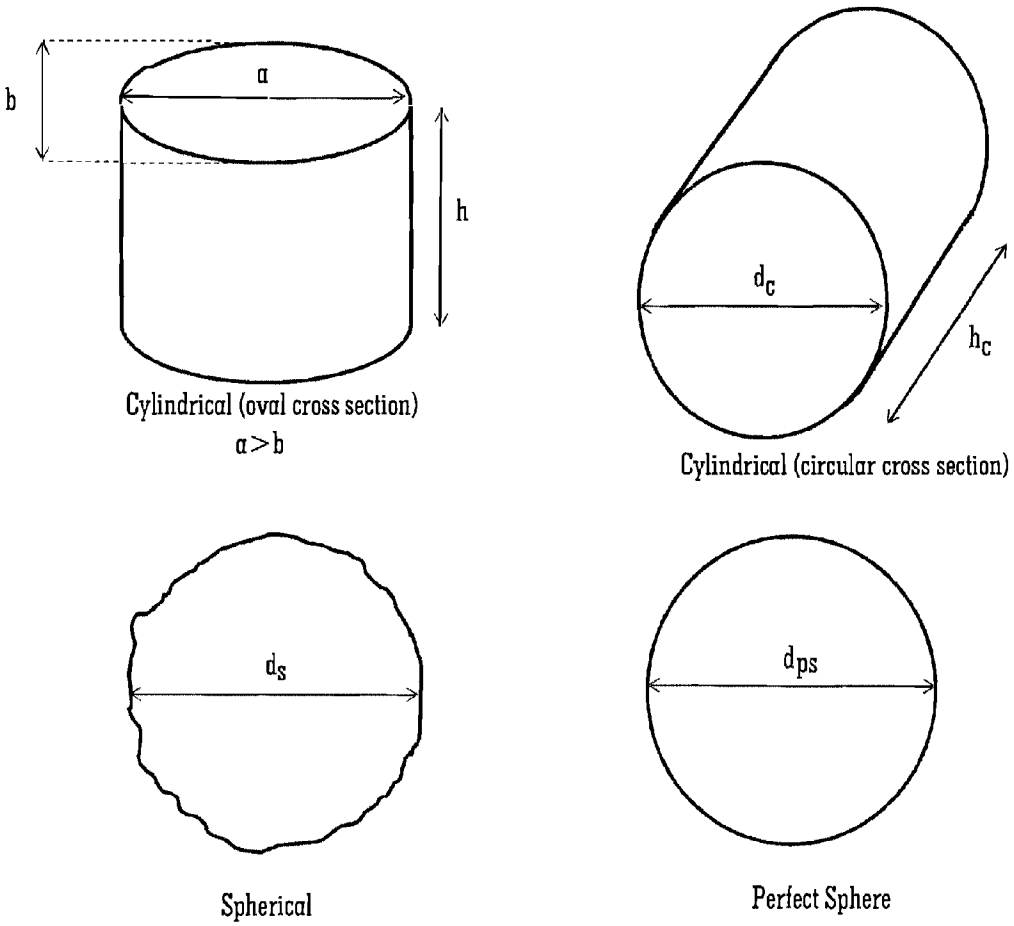
FIG. 3 is a diagrammatic representation of particles which are employed in the method of the invention.

Referring now to FIG. 2, there is seen an illustration of the means for release of the solid particulate material from the collecting compartment of a lifter (4) into repository (6) for an apparatus as shown in FIG. 1. Thus, in step 1, it is seen that the regulating means in the form of door (5) causes solid particulate material (7) to be held within the collecting compartment of lifter (4) until, in step 2, the door (5) is mechanically caused to open by the action of actuation means comprising protrusion (8) on the surface of the repository (6) during rotation of the drum (2) thereby allowing the solid particulate material to fall into repository (6). Finally, in step 3, as rotation of the drum continues, the door (5) returns to the closed position Turning finally to FIG. 3, there is provided a diagrammatic representation of different cylindrical and spherical particles which may be utilised according to the method of the invention.

The invention will now be further illustrated, though without in any way limiting the scope thereof, by reference to the following examples.

1. Examples

Cleaning experiments were conducted using a set of Examples and Comparative Examples (see Table 1). Examples were performed using the treatment apparatus (washing machine) according to the present invention in the form of a prototype Xeros US washer. The Comparative Examples were carried out on a top of the range US Samsung washer having the model number WF435 with the same drum volume as used in the treatment apparatus according to the present invention. The experiments were conducted, as far as possible, in accordance with British Standard EN 60456. One exception to this standard was the use of a conventional liquid detergent, the components of which were:

Non-ionic surfactant blend: 5-10 wt %
Anionic surfactant blend: 15-20 wt %
Enzyme blend: 1-5 wt %
Solvents: 10-15 wt %
Builders: 1-5 wt %
Minor components (optical brightener, fragrance etc.): 1-5 wt %
Water: balance 6 stain monitors (EMPA 109) were added to a 6 kg washload to quantify the cleaning performance. The experiments were conducted with both cold and heated cycles using both the US Samsung washer (Comparative Examples) and Xeros US washer (Examples). For the cold cycles using the Xeros US washer, 3 trial variations were performed, namely: Top Clean, Eco and Super Eco each, respectively, using less water. For the heated cycles using the Xeros US washer, 2 trial variations were performed, namely: Top Clean and Eco again with Eco using less water. The same polypropylene beads (particulate solid) with a constant total surface area (10.4 $m^2$) were used in all Xeros US washer experiments. For the US Samsung washer Normal (cold) and Heavy Duty (heated) cycles were used. Experiments using both apparatus used a constant inlet cold water temperature of 20° C. and hot water temperature of 40° C.

The extraction speeds during the cycle were matched as closely as possible. The experiments were repeated 20 times.

TABLE 1

| Test # | Washload (kg) | Detergent Dosage (g) | Cold Water (L) | Hot Water (L) | Total Water (L) | Cycle Time (min) |
|---|---|---|---|---|---|---|
| Samsung Normal | 6 | 45 | 54 | 1 | 55 | 49 |
| Xeros Top Clean Cold | 6 | 45 | 41.7 | 0 | 41.7 | 70 |
| Xeros Eco Cold | 6 | 45 | 31.5 | 0 | 31.5 | 63 |
| Xeros Super Eco-Cold | 6 | 45 | 22.5 | 0 | 22.5 | 63 |
| Samsung Heavy Duty | 6 | 45 | 70 | 15 | 85 | 103 |
| Xeros Top Clean Heated | 6 | 45 | 42.5 | 18.5 | 61 | 94 |
| Xeros Eco-Heated | 6 | 45 | 32.5 | 18.5 | 51 | 88 |

2. Results

The cleaning performance was quantified using colour measurements.

Reflectance measurement values of the EMPA stain monitors were measured using a Konica Minolta spectrophotometer interfaced to a personal computer, running SpectraMagic™ NX software. The Y value was taken for each stain on the stain monitors. It should be noted that higher Y values indicate better cleaning. The average results for cold cycles were as set out in Table 2 and the average results for the heated cycles were as set out in Table 3.

TABLE 2

| Stain Type | Samsung Normal | Xeros Top Clean | Comments | Xeros Eco | Comments | Xeros Super Eco | Comments |
|---|---|---|---|---|---|---|---|
| Cotton | 92.57 | 91.14 | Parity | 90.9 | Parity | 90.79 | Parity |
| Sebum | 62.7 | 65.76 | Superior | 63.99 | Parity | 63.92 | Parity |
| Carbon Black | 33.8 | 38.98 | Superior | 37.37 | Superior | 37.13 | Superior |
| Blood | 42.78 | 46.09 | Superior | 45.63 | Superior | 46.64 | Superior |
| Cocoa | 48.31 | 51.67 | Superior | 49.68 | Parity | 49.85 | Parity |
| Red Wine | 58.91 | 60.03 | Parity | 59 | Parity | 59.10 | Parity |

TABLE 3

| Stain Type | Samsung Heavy Duty | Xeros Top Clean | Comments | Xeros Eco | Comments |
|---|---|---|---|---|---|
| Cotton | 91.16 | 89.95 | Parity | 89.98 | Parity |
| Sebum | 68.87 | 70.68 | Parity | 70.01 | Parity |
| Carbon Black | 39.51 | 43.2 | Superior | 42.43 | Superior |
| Blood | 54.62 | 53.88 | Parity | 54.28 | Parity |
| Cocoa | 55.49 | 57.68 | Superior | 56.11 | Parity |
| Red Wine | 60.96 | 60.51 | Parity | 59.87 | Parity |

As can be seen from Table 2, the Xeros Top Clean cold cycle provided superior cleaning performance as compared to the Samsung Normal cycle. Of the 5 stains (cotton measures redeposition rather than cleaning), 4 stains showed superior cleaning performance, with parity being obtained with Red Wine. This is largely because Red Wine is a stain that tends to require bleaching, and so one with which beads are less likely to have a substantial effect. With a reduction of 10 L of water usage with the Eco cycle and a further reduction of 9 L with the Super Eco cycle, the effect was to reduce the number of stains which showed superior cleaning down to 2, namely: Carbon Black and Blood. Of particular interest was the performance on Sebum at low temperature and Blood with less water. The cleaning performance achieved with the Xeros US washer apparatus with the temperature and low water levels clearly showed the benefit of beads on the cleaning performance. The superior performance on Carbon Black throughout was evidence of the superior mechanical action that the beads provided during the cleaning process.

As can be seen from Table 3, the Xeros Top Clean heated cycle again gave superior performance as compared to the Samsung Heavy Duty cycle on 2 of the 5 stains (Carbon Black and Cocoa). The effect of the increased wash temperature was to reduce the benefit of beads on cleaning performance. The benefit was further reduced to being superior for 1 stain, (Carbon Black) for the Eco Heated cycle, here the water usage was reduced by a further 6 L. However, the evidence that the beads enhanced mechanical action was again demonstrated by the superior cleaning performance obtained for Carbon Black stains.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An apparatus for use in the treatment of substrates using a solid particulate material, said apparatus comprising:

(a) housing means having:
  (i) a first upper chamber having mounted therein a rotatably mounted cylindrical cage, and
  (ii) a second lower chamber located beneath said cylindrical cage;
(b) at least one recirculation means;
(c) access means;
(d) pumping means; and
(e) a multiplicity of delivery means, wherein said rotatably mounted cylindrical cage additionally comprises collecting and transferring means, adapted to facilitate collection of said solid particulate material and transfer of said material to said at least one recirculation means, wherein said collecting and transferring means comprises a plurality of compartments located at equidistant intervals on the inner circumferential surface of said rotatably mounted cylindrical cage.

2. An apparatus as claimed in claim 1 wherein said collecting and transferring means comprises at least one receptacle comprising a first flow path facilitating ingress of fluids and solid particulate material from said rotatably mounted cylindrical cage and a second flow path facilitating transfer of said fluids and solid particulate material to said recirculation means.

3. An apparatus as claimed in claim 2 wherein said second flow path comprises at least one orifice in the side wall of said rotatably mounted cylindrical drum, said at least one orifice having a diameter which allows said solid particulate material to transfer to said recirculation means.

4. An apparatus as claimed in claim 2 wherein said collecting and transferring means comprises regulating means, located in said second flow path and adapted to control the transfer of said solid particulate material to said recirculation means.

5. An apparatus as claimed in claim 4 wherein said regulating means comprises an openable door or flap.

6. An apparatus as claimed in claim 5 wherein said regulating means comprises a revolving door.

7. An apparatus as claimed in claim 4 wherein said regulating means is caused to open and close by actuating means comprising at least one of mechanical means, electrical means and magnetic means.

8. An apparatus as claimed in claim 1 wherein said collecting and transferring means is adapted such that ingress of fluids and solid particulate material into said collecting and transferring means is controlled by the direction of rotation of said rotatably mounted cylindrical cage.

9. An apparatus as claimed in claim 1 wherein said collecting and transferring means is comprised in spaced apart lifters affixed to the inner surface of said rotatably mounted cylindrical cage.

10. An apparatus as claimed in claim 1 wherein said at least one recirculation means facilitates recirculation of fluids from said lower chamber to said rotatably mounted cylindrical cage.

11. An apparatus as claimed in claim 10 wherein said recirculation means additionally comprises ducting which connects said lower chamber and said rotatably mounted cylindrical cage.

12. An apparatus as claimed in claim 11 wherein said ducting comprises control means, adapted to control entry of said solid particulate material into said cylindrical cage.

13. An apparatus as claimed in claim 1 wherein said rotatably mounted cylindrical cage comprises a drum comprising solid side walls with no perforations.

14. An apparatus as claimed in claim 1 wherein said rotatably mounted cylindrical cage comprises a drum comprising perforated side walls with perforations having a diameter no greater than 3.0 mm.

15. A method for treating a substrate, said method comprising the treatment of the substrate with a formulation comprising solid particulate material, wherein said method is carried out in an apparatus as claimed in claim 1.

16. A method as claimed in claim 15, said method comprising cleaning at least one substrate which comprises at least one soiled substrate.

17. A method as claimed in claim 16 wherein said at least one soiled substrate comprises at least one textile fibre garment.

18. A method as claimed in claim 16 wherein said method comprises the steps of:
(a) introducing a solid particulate cleaning material and water into the second lower chamber of an apparatus according to the first aspect of the invention;
(b) agitating and heating said solid particulate cleaning material and water;
(c) loading at least one soiled substrate into said rotatably mounted cylindrical cage via said access means;
(d) closing the access means so as to provide a substantially sealed system;
(e) introducing said water and solid particulate cleaning material into said rotatably mounted cylindrical cage via said recirculation means;
(f) operating the apparatus for a wash cycle, wherein said rotatably mounted cylindrical cage is caused to rotate and wherein fluids and solid particulate cleaning material are caused to enter said collecting and transferring means via first flow paths to be transferred along second flow paths to said recirculation means in a controlled manner;
(g) operating said pumping means so as to transfer fresh solid particulate cleaning material and recycle used solid particulate cleaning material via said recirculation means to separating means;
(h) operating control means so as to add said fresh and recycled solid particulate cleaning material to said rotatably mounted cylindrical cage in a controlled manner; and
(i) continuing with steps (e), (f), (g) and (h) as required to effect cleaning of the soiled substrate.

19. A method as claimed in claim 18 wherein, on completion of the wash cycle, rotation of said rotatably mounted cylindrical cage is caused to occur at a G force of less than 1 so as to allow for removal of said solid particulate cleaning material to storage means.

* * * * *